343-700 MS AU 254 EX
1/17/84 OR 4,426,649

United States Patent [19]

Dubost et al.

[11] 4,426,649

[45] Jan. 17, 1984

[54] FOLDED BACK DOUBLET ANTENNA FOR VERY HIGH FREQUENCIES AND NETWORKS OF SUCH DOUBLETS

[75] Inventors: Gérard Dubost; Claude J. Vinatier, both of Rennes, France

[73] Assignees: L'Etat Francais, representé par le Secretaire d'Etat aux Postes et des a la Telediffusion (Centre National d'Etudes des Telecommunications), Issy-les-Moulineaux; Etablissement Public de Diffusion dit "Telediffusion de France", Montrouge, both of France

[21] Appl. No.: 284,702

[22] Filed: Jul. 20, 1981

[30] Foreign Application Priority Data

Jul. 23, 1980 [FR] France ..... 80 16620

[51] Int. Cl.[3] ..... H01Q 1/38; H01Q 9/26

[52] U.S. Cl. ..... 343/700 MS; 343/803; 343/813

[58] Field of Search ..... 343/803, 700 MS, 813, 343/829, 830, 846

[56] References Cited

U.S. PATENT DOCUMENTS

| | | | |
|---|---|---|---|
| 2,874,276 | 2/1959 | Dukes et al. | 343/781 |
| 4,005,430 | 1/1977 | Dubost et al. | 343/803 |
| 4,084,162 | 4/1978 | Dubost et al. | 343/803 |

*Primary Examiner*—Eli Lieberman
*Attorney, Agent, or Firm*—Laff, Whitesel, Conte & Saret

[57] ABSTRACT

The invention relates to doublet plates and the method of making them so that they may operate at very high frequencies.

5 Claims, 4 Drawing Figures

FOLDED BACK DOUBLET ANTENNA FOR VERY HIGH FREQUENCIES AND NETWORKS OF SUCH DOUBLETS

The present invention relates to doublets or antenna which are folded back to form plates for operating at very high frequencies.

French Pat. No. 2,311,422 has already described a folded back doublet comprising:

Two symmetrical half-plates separated by a cut.

A continuous long plate separated from the adjacent sides of the half-plates by an interval. The half-plates constitute the strand which is fed and the long continuous plate constitute the folded back strand. The common width of the two half-plates are much larger than the width of the continuous long plate. The ends of the continuous long plate are respectively connected to the external ends of the half-plates.

A conductor feeds the doublet in the neighborhood of the cut and is directed according to the axis of symmetry of the half-plates.

A reflector plane has a size which is much greater than the size of the doublet. The distance between the reflector plane and the doublet are small relative to the wave length λ. The length of the doublet is less than or equal to 0.5λ, the width of the doublet being less than 0.25λ. In practice, the half-plates are rectangular, except, of course, close to the cut where the corners are cut. The continuous long plate also is rectangular.

In addition, in known doublets, the feeding line is a band-type conductor, the mass ground plate of which is first constituted by a plate which is perpendicular to the continuous long plate, then by the continuous long plate, then by the surface connecting the continuous long plate to one of the half-plates and, finally by the half-plate itself. The band type line is soldered or welded at one end or connected to the half-plate which does not serve as a mass ground plate for it, close to the cut and, at its other end to a "band-type line— coaxial line" passage.

In the embodiments which have been described in French Pat. No. 2,311,422, there were considered operating frequencies reaching up to 5 GHz.

It has been sought to utilize the doublet described in French Pat. No. 2,311,422 at frequencies which are definitely higher, and in of the order of 12 GHz. To that end, it was logical to proceed to a reduction of all of the dimensions, including the thickness of the printed circuit. That reduction in thickness causes exaggerated losses for the feeding band-type line. If the dimensions are reduced while maintaining the thickness of the printed circuit in order not to decrease the efficiency of the doublet, there is a radiation of the feeding line, the dimensions of which no longer are negligible relative to the wave length. In addition, under those conditions, ther is a degradation of the level of a crossed component, relative to the operation at lower frequency, because the doublet is no longer being linearly polarized.

One object of the present invention is to provide for a doublet which is folded back into plates, and which avoids the above-indicated drawbacks, especially by avoiding the radiation of the feeding line and reducing the crossed component.

According to a characteristic of the present invention, there is provided a folded back doublet comprising:

Two symmetrical half-plates which are separated by a cut;

A first and a second continuous long plates, separated on the adjacent sides of the half-plates, by an interval, the half-plates constitute the feed strand. The first long continuous plate constitutes the folded back strand. The second continuous long plate is symmetrical to the first one relative to the longitudinal axis of symmetry of the half-plates. The common width of the two half-plates are appreciably larger than that of the continuous long plates. The ends of the continuous long plates are respectively connected to the external ends of the half-plates.

A triplate line feeds the doublet close to the cut and has its end part directed in the direction of the axis of symmetry of the half-plates.

A reflector plane is constituted by a continuous plate which is one of the mass surfaces of the triplate line.

According to another characteristic, perpendicular to the two continuous long plates, in their median areas opposed to the intervals, there are symmetrical conductor parts which are relatively wide, and which serve as mass surfaces to the triplate line.

According to another characteristic, the wide plates are integrally joined by a symmetrical plate in which there are cut out hollow parts the edges of which are relatively distant from the half-plates of the doublet.

As indicated above, in known doublet described in French Pat. No. 2,311,422, the end of the band-type line is joined to the half-plate which does not serve as its mass plate, close to the cut. That junction is executed by a passage through the printed circuit and a soldering or welding of the conductor to the half-plate. When networks comprise a large number of elementary doublets, it is preferable to limit the number of solderings or weldings. That is why one object of the invention consists in providing for a doublet folded into plates, which avoids any soldering or welding for the coupling of the feeding line.

According to another characteristic, a doublet is folded back into plates, in which the central conductor of the triplate feeding line runs under a half-plate, then under the cut, then under the second half-plate, to an open end, at one quarter of a wave length of the cut.

According to another characteristic, a network of doublets, according to the present invention, use the doublets in association. The central conductors of a couple of doublets are aligned and meet on the axis of symmetry of the couple, relative to which the doublets of the couple are symmetrical, at the point called "center of the couple". The couples are associated in pairs, in which the second couple is dedcuted from the first one by translation parallel to the axis of symmetry, over a distance which is equal to the distance between the middle points of the cuts of the doublets of one couple. The centers of the couples of the pair are joined by a conductor segment the middle of which constitutes the center of the pair. The network is constituted of $2^n \times 2^n$ pairs of couples. The centers of the pairs are arranged as a matrix, the steps or pitch of which are equal horizontally and vertically, the feeding conductors spreading from the center of the network forming a pattern somewhat like a succession of Malta crosses.

The above-indicated characteristics of the invention, as well as others, will appear more clearly upon a reading of the following description of embodiments of the invention. The description being given relative to the attached drawing, in which.

Figure 1:
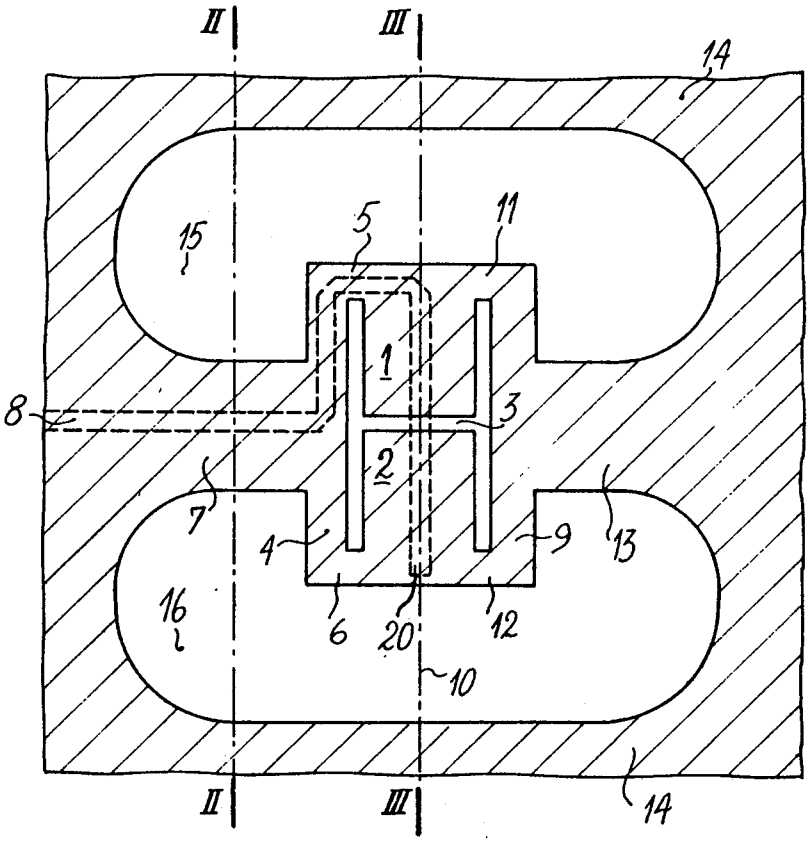
FIG. 1 is a plane view of a doublet folded back antenna into plates according to the present invention.

The folded back doublet antenna in FIG. 1 comprises a strand formed of two half-plates 1 and 2, separated by a cut 3. A folded back strand is formed of a continuous long plate 4 and of two symmetrical portions 5 and 6 which symmetrically connect on one side 1 and and 4 and, on the other side 2 and 4. From a purely structural point of view, each half-plate 1 or 2 is a true rectangular plate, the length of which is close to one-half the length of the doublet. However, considering that their radioelectric functions are closely connected to their length, it has seemed more practical to designate them by the expression "half-plate" which is opposed to the expression "plate" used for the folded back strand which occupies the entire length of the doublet.

Plate 4 is connected, in its central part, to a mass or ground plate 7, perpendicular to plate 4 and symmetrical, relative to the axis of symmetry of the doublet, of the central conductor 8 of a triplate line. The central conductor 8 is indicated, in FIG. 1, by dash lines, because it runs in succession under plates 7, 4, 5 and 1, each one of the metallic surfaces 7, 4, 5 and 1 serves as a mass or ground surface of one side of conductor 8. Especially, under half-plate 1, line 8 is located at equal distances from the sides of 1.

In addition, the doublet in FIG. 1 comprises a second continuous long plate 9 which is symmetrical to plate 4 relative to the axis of symmetry 10 of the two half-plates 1 and 2, and two symmetrical portions 11 and 12 which respectively join for one part 1 and 9 for the other part, 2 and 9. Parts 11 and 12 respectively are symmetrical to parts 5 and 6, relative to axis 10.

Plate 9 is connected, in its central part, to a plate 13, which is perpendicular to plate 9 and symmetrical to plate 7 relative to axis 10. Plates 7 and 13 are, in fact, part of a same large plate 14 which surrounds the doublet itself. Openings 15 and 16 have a general bean shape, separating the doublet from plate 14. Of course, openings 15 and 16 are symmetrical relative to the axis of symmetry of the doublet perpendicular to axis of symmetry 10 and also relative to axis 10.

Figure 2:
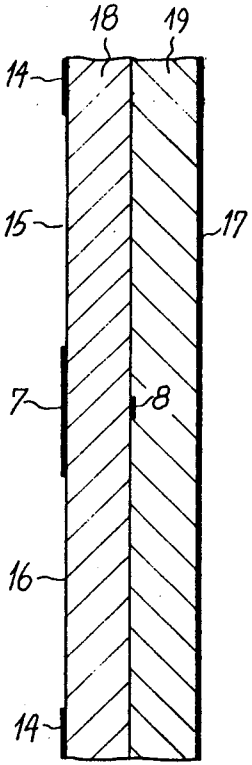
FIG. 2 is a section view of the doublet in FIG. 1, the cross section being taken along line II—II.

Plate 9, parts 11 and 12 and plate 13 bring about a perfect symmetrization of the folded doublet relative to axis 10, with as a result, an appreciable reduction of the crossed component As shown in the section view in FIG. 2, the central conductor 8 forms with plate 7 for one part and with a ground plate 17 for the other part, a triplate feeding line. In practice, the metallic elements 1, 2, 4, 5, 6, 7, 9, 11, 12, 13 and 14 form a face of a first printed circuit 18 while the central conductor 8 forms the other face of that printed circuit. Against the face of printed circuit 18, which carries conductor 8, there is applied the bare face of a second printed circuit 19, the opposite face of which is uniformly covered with metallic plate 17. The insulating element of printed circuits 18 and 19 may be the same one, for example polyguide, with a relative electric permittivity $\epsilon_r$ equal to 2.32. The two circuits may have the same thickness. The continuous metallic plate 17 serves both as a ground plate for the triplate feeding line and as a reflector for the radiating parts 1 and 2 of the doublet.

Hollowed out parts 15 and 16 must be sufficiently large to prevent an exaggerated coupling between the radiating couplet and the mass ground plate 14 of the triplate line.

From plate 7, the central conductor 8 is extended, in succession, under one half of plate 4 (toward part 5), then under part 5, then under half-plate 1 and, finally, after passage under cut 3, and under a part of half-plate 2. Of course, each one of the different segments which constitute the central conductor is always located under the axis of symmetry of the plate which covers it. The precise mechanical positioning of the two faces of the printed circuit is obtained by using the conventional techniques for fabricating printed circuits. It must be noted that, as metallic surface 17 is continuous, the positioning of circuit 19, relative to circuit 18, is not critical.

The distance between the end 20 of conductor 8 and the middle of cut 3 is equal to one-quarter of a wave length, that is to say, equal to $\lambda/4$, in which $\lambda$ designates the wave length in the insulating medium of printed circuits 18 and 19, with:

$$= \frac{c}{f\sqrt{\epsilon_r}}$$

in which c is the speed of the electromagnetic waves in vacuum.

Thus, the quarter wave line under half-plate 2 is open, that causing a short-circuit under the edge of the half-plate 2 which is adjacent to cut 3. Thus it appears that the quarter wave line makes it possibe to avoid a passage through circuit 18 and a need for soldering or welding.

Figure 3:
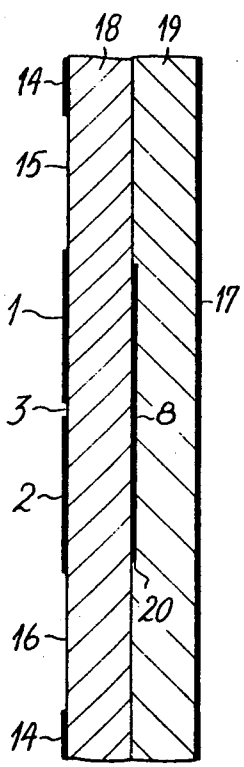
FIG. 3 is a section view of the doublet in FIG. 1, the cross section being taken along line III—III.
Figure 4:
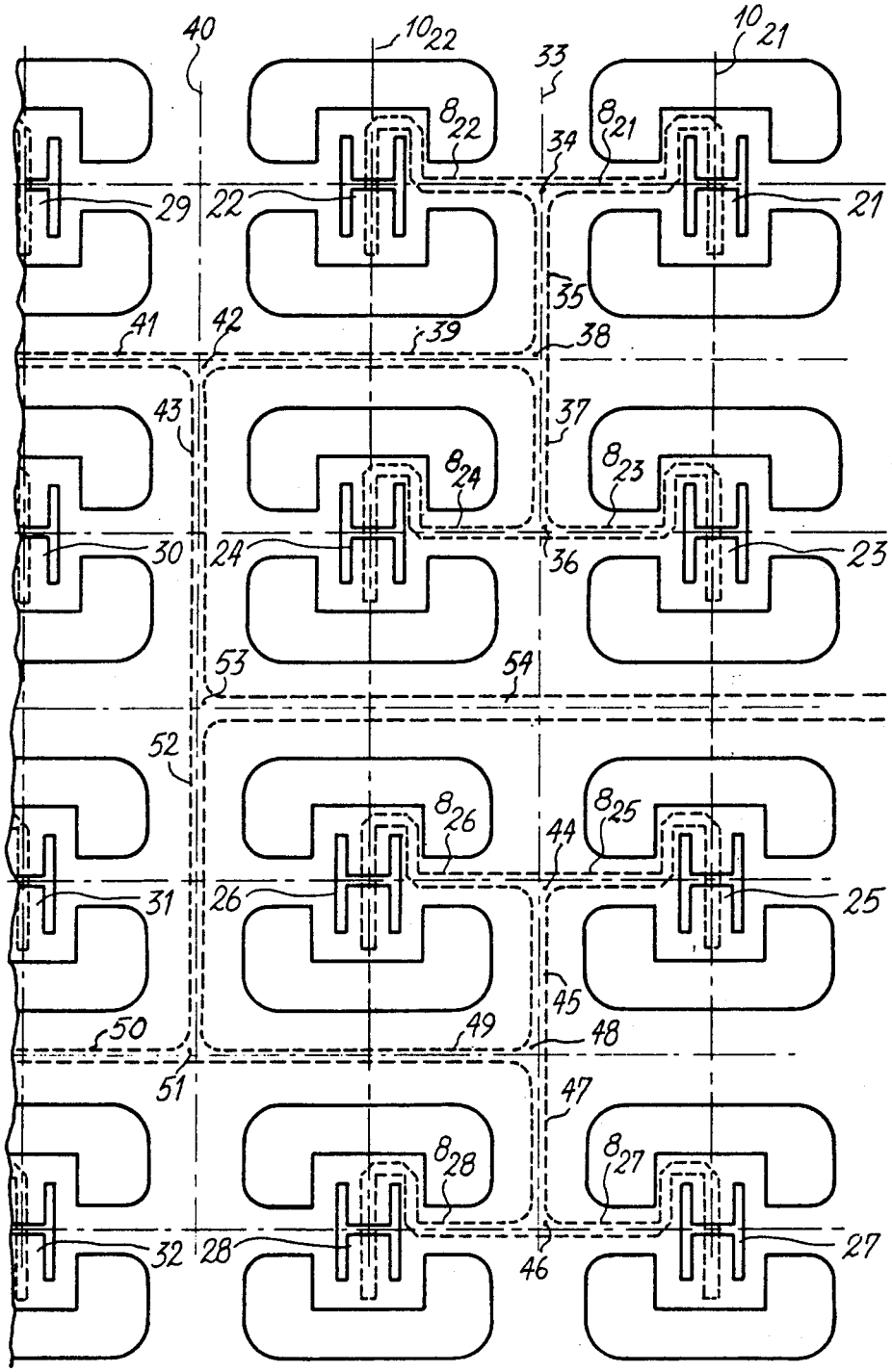
FIG. 4 is a partial view in plane, of a two dimensional network of doublets according to FIG. 1.

The doublet in FIGS. 1 to 3 may, of course, be used as the radiating source of a network. FIG. 4 shows how, from the doublet in FIG. 1, it is possible to create such a network. The network part shown in FIG. 4 comprises the doublets 21 to 32, identical to the doublet in FIG. 1. Doublet 21 is oriented as in FIG. 1. This means that the central conductor $8_{21}$ is to the left, when looking at the Figure, of axis $10_{21}$. On the other hand, doublet 22 is symmetrically oriented, that is to say, the central conductor $8_{22}$ is to the right to axis $10_{22}$. In the two doublets 21 and 22, the half-plates $10_{21}$ and $10_{22}$ are located above the axis running through 33. In other words, doublets 21 and 22 are symmetrical relative to a line 33 which is parallel to axis 10 of the doublets. Conductors $8_{21}$ and $8_{22}$, which are lined up, meet at point 34 and are extended by a conductor 35 which descends under line 34.

Doublets 23 and 24 are deduced from doublets 21 and 22 by a translation in the direction of 34, the magnitude of which is equal to the distance betwween the centers, that is to say, the middles of their cuts, of 21 and of 22. The central conductors $8_{23}$ and $8_{24}$ meet in a point 36 from where they are extended upward by 37 under the line 34. Conductors 35 and 37 meet in point 38 and are extended toward the left by conductor 39.

Doublets 29 and 30 are part of a group of four symmetrical doublets of the group of the four doublets 21 to 24, relative to a line 40, parallel to 34. The distance between the centers of doublets 22 and 29 is equal to that which exists between the centers of doublets 21 and 22. The group which comprises doublets 29 and 30 is fed by central conductors which are symmetrical with condutors feeding 21 to 24. Thus, there is a conductor 41 which is similar to conductor 39 and which meets conductor 39 at point 42 on line 40. From there, the central conductor is extended by a descending segment 43.

Doublets 25 to 28 are deduced from doublets 21 to 24 by translation downwardly by a distance equal to double the distance between the centers of two adjacent doublets. Conductors $8_{25}$ and $8_{26}$ meet at point 44 where the segment of central conductor 45 ends, which is identical to conductor 35. Conductors $8_{27}$ and $8_{28}$ meet at point 46 at which ends the segment of central conductor 47, which is identical to conductor 37. Segments 45 and 47 meet at point 48 where the segment of central conductor 49 ends, which is identical with conductor 39.

Doublets 31 and 32 are part of a group of four doublets which are symmetrical with the four doublet group 25 to 28, relative to line 40. The group is fed through central conductors which are symmetrical to the conductors feeding doublets 25 to 28. Thus, a conductor 50 meets conductor 39 at point 51, on line 40. From there, the central conductor is extended by an ascending segment 52 which meets the descending segment 43 at point 53 at which a segment of central conductor 54 ends.

The description which precedes makes it possible for the man skilled in the art to see how, after having associated two doublets, four are associated, then sixteen to form a network in which the centers of the doublets coincide with the crossing points of the horizontal and vertical lines of a square matrix. It will be possible to verify that from point 53 to conductor $8_1$ of each doublet, the trajectory covered is the same. In the horizontal direction, the passage from one group of $2^p$ doublets to the next is done symmetrically while, in the vertical direction, passage from the group of $2^p$ doublets to the following one is done by translation as far as the doublets, properly speaking, are concerned, and by symmetry as far as their feeding conductors are concerned. Those remarks make is possible for the technician to understand how the network of $2^4$ doublets can be extended to $2^5$, $2^6$, etc.

As an indication, for a doublet, according to the invention which is supposed to operate in a frequency range of 11 to 12.4 GHz, the length of the doublet is 8.5 m, that is to say, approximately equal to $\lambda/2$, in which $\lambda$ is the wave length in the dielectric at the means frequency of the band. It will be recalled that there was chosen, for the insulating boards 18 and 19 of the printed circuit, a dielectric for which $\epsilon_r$ is 2.32. The width of the half-plates 1 and 2 is 3 mm and the distance of the doublet to the reflector plane 17 is 3.2 mm, that is to say, approximately 0.19$\lambda$. The width of the central conductor 8 is 0.5 mm. The hollowed out parts 15 and 16 have a length of the order of 16 mm and a maximum width of the order of 6.5 mm. The width of cut 3 is equal to 0.35 mm. The width of parts 7 and 13 is of the order of 3 mm. The intervals between parts 4 and 9 and the half-plates 1 and 2 have a width of 0.5 mm. The width of 4 or 9 is 1 mm, as are the width of 5, 6, 11 and 12. The thicknesses of circuits 18 and 19 are 1.6 mm.

The following Table gives the radio electric characteristics measured on such a doublet as a function of the frequency, that is to say, the R.O.S. (Stationary wave ratio) of the intake impedance brought to 50 ohms the openings $\theta^3$ and $\theta^h$ in the plane E and H, the linear, isotropic $G_M$ gain the level N(dB) of crossed component in the axis of the main radiation of the doublet. The efficiency of the doublet calculated from the measured gain and from the directivity obtained by the integration of the diagrams for seven frequencies has a mean value 91%, that is to say, a loss of 0.4 dB.

TABLE

| f (GHz) | 11,1 | 11,5 | 11,7 | 11,8 | 11,9 | 12 | 12,1 | 12,3 | 12,4 |
|---|---|---|---|---|---|---|---|---|---|
| R.O.S. | 2,10 | 1,30 | 1,20 | 1,30 | 1,35 | 1,35 | 1,30 | 1,13 | 1,08 |
| $G_M$ (dB) | 6,50 | 7,80 | 7,75 | 7,70 | 7,18 | 7,55 | 7,60 | 7,75 | 7,80 |
| $\theta_{dB}{}^E$ (degree) | | 100 | 96 | | 97 | | 91 | | 87 |
| $\theta_{dB}{}^H$ (degree) | | 70 | 70 | | 69 | | 64 | | 73 |
| N(dB) | | −24 | −24 | | −40 | | −27 | | −24 |

in the network in FIG. 4, the centers of the doublets may be placed at 22 mm; the width of the conductors 35, 37, 45, 47, 39, 41, 49, 50, 43 and 52 may be chosen equal to 1.1 mm and the width of conductor 54 is equal to 2.3 mm. The impedances of the conductors 2.3 mm, 1.1 mm and 0.5 mm respectively are 50 ohms and 102.5 ohms.

We claim:

1. A folded back doublet antenna for operating at very high frequencies, said doublet antenna comprising at least one printed circuit board having conductive areas thereon which provide:

feed means in the form of two symmetrical half-plates separated by an insulating cut;

folded back means which comprises first and second continuous long plates which are symmetrically positioned with respect to the longitudinal axis of symmetry of the two symmetrical half-plates and which are separated from the adjacent sides of the half-plates by an interval;

the common width of the two half-plates being appreciably more than the width of the continuous long plates (4, 9) and the ends of the continuous long plates respectively being joined to and integral with the ends of the half-plates which are removed from said insulating cut;

a triplate conductive line which feeds the doublet at a point which is close to said insulating cut and which has its end part directed in the same direction as the axis of symmetry of the half-plates and a reflector plane formed by a continuous plate which is a ground surface of a triplate line.

2. The doublet according to claim 1, and symmetrical conducting parts which are relatively wide and which serve as a ground surface for the triplate line, said conducting parts extending perpendicularly to the two continuous long plates, in their median regions opposite the intervals.

3. The doublet according to claim 2, wherein the wide plates are joined by a symmetrical plate having hollow cut out areas, the edges of which are relatively distant from the half-plates of the doublet.

4. The doublet according to any one of the claims 1 to 3 wherein a central conductor of the triplane feeding line runs on a side of said printed circuit board which is opposite to and under a half-plate, then the insulating cut, then under the second half-plate to an open end located one quarter of a wave length away from said cut.

5. A network of doublet antennas according to any one of claims 1 to 4 wherein there are a plurality of said doublets, the doublets being associated with each other in couples central conductors of at least some of said couples of said doublets being aligned and meeting at points in the center of the couple on an axis of symmetry of the couple relative to which the doublets of the couple are symmetrical, the couples being associated in pairs in which a second couple is deducted from the first couple by a translation which is parallel to said axis of symmetry, said transmission being over a distance which is equal to the distance between the middle points of the insulating cuts of the doublets of a couple, the centers of the couples of the pair being joined by a conductor segment the middle of which constitutes the center of the pair, the network being constituted of $2^n \times 2^n$ pairs of couples, the centers of the pairs being arranged to form a matrix, the steps of said matrix being horizontally and vertically equal, the feeding conductors spreading from the center of the network in a geometry which forms successive Malta crosses.

* * * * *